US005550436A

United States Patent [19]

Houk

[11] Patent Number: 5,550,436

[45] Date of Patent: Aug. 27, 1996

[54] MOS GATE DRIVER INTEGRATED CIRCUIT FOR BALLAST CIRCUITS

[75] Inventor: Talbott M. Houk, Culver City, Calif.

[73] Assignee: International Rectifier Corporation, El Segundo, Calif.

[21] Appl. No.: 299,561

[22] Filed: Sep. 1, 1994

[51] Int. Cl.[6] ..... H05B 41/00

[52] U.S. Cl. ..... 315/209 R; 315/224; 315/225; 315/DIG. 7; 315/219; 315/360; 363/49

[58] Field of Search ..... 315/209 R, 224, 315/225, DIG. 7, 360, 219; 363/24, 49, 17, 98; 327/142, 143

[56] References Cited

U.S. PATENT DOCUMENTS 5,001,400 3/1991 Nilssen ..... 315/209 R

OTHER PUBLICATIONS

Peter N. Wood, "Electronic Ballasts Using Cost-Saving IR2155 Driver," Application Notes, AN-995, International Rectifier, Feb.'94.

"High Voltage Versatility", Electronics World & Wireless World, pp. 837-839, Oct. 1994.

*Primary Examiner*—Robert Pascal
*Assistant Examiner*—Arnold Kinkead
*Attorney, Agent, or Firm*—Ostrolenk, Faber, Gerb, & Soffen, LLP

[57] ABSTRACT

A monolithic MOS gate driver chip is described for driving high side and low side power MOSFETs in a gas discharge lamp ballast circuit. The chip includes a timer circuit for generating a square output at the natural frequency of resonance of the lamp ballast. Dead time circuits are provided in the chip to prevent the simultaneous conduction of both high side and low side MOSFETs. The chip may be housed in an eight pin DIP package.

20 Claims, 5 Drawing Sheets

L1
L2
N
75
76
71a
71b
77
78
74
79
41
42
22
43
20
21
49
40
VB
HO
VS
LO
VCC
RT
CT
G
1
2
3
4
5
6
7
8
RT
CT
23
60
61
62
63
64
66
67
68
69
70
70a

L1
L2
AC INPUT
74
41
42
43
20
21
26
40
Vcc
VB
Ho
Vs
Lo
RT
CT
CT
CT
RT
50
51
91
HPS
90
92
93
94
95
96
SYNC
SHUTDOWN 97
98
25
24
27
26
20
21
44
43
99
VB
HO
VS
LO
VCC
RT
CT
G
40
RT
CT
41
42
22
23
+
-

MOS GATE DRIVER INTEGRATED CIRCUIT FOR BALLAST CIRCUITS

RELATED APPLICATIONS

This application is related to copending application Ser. No. 08/206,123, filed Mar. 4, 1994, entitled "MOS GATE DRIVER FOR BALLAST CIRCUITS", in the name of Peter Wood, and assigned to the assignee of the present application.

BACKGROUND OF THE INVENTION

This invention relates to a gate driver integrated circuit for MOS gated devices, and more specifically relates to a monolithic gate driver circuit for MOS gated circuit devices, particularly those used in lamp ballast circuits.

Electronic ballasts for gas discharge circuits are coming into widespread use because of the availability of power MOSFET switching devices to replace previously used power bipolar transistor devices. Most electronic ballasts use two power MOSFET switches in a totem pole (half bridge) topology, with the gas discharge tube circuits consisting of L-C series resonant circuits in which the lamp or lamps are connected across one of the reactances of the L-C circuit. The power MOSFET switches are then driven to conduct alternately by inputs from secondary windings on a current transformer, the primary winding of which conducts the current of the lamp circuits. The primary winding current alternates at the resonant frequency of the resonant circuit.

Such prior art circuits have numerous drawbacks. For example, such circuits:

1. Are not self-starting and require a DIAC type device to initially pulse the circuit into operation.
2. They have poor switch times.
3. They are labor intensive due particularly to the need for a toroidal current transformer.
4. The circuits are not amenable to dimming.

BRIEF SUMMARY OF THE INVENTION

The present invention provides a novel monolithic or integrated circuit MOS gate driver which permits the driving of low side and high side power MOSFETS or IGBTs (or any other MOS gated type device) from logic level, ground referenced inputs. Such circuits are particularly well adapted for the driving of gas discharge lamp ballast circuits.

More specifically, the MOS gate driver of the invention can be used for the drive of lamp ballast circuits or, more generally, any desired MOS gated circuit, and provides the following features:

1. It provides gate drive voltage signals for two MOS gated power semiconductors such as power MOSFETs or IGBTs, one designated as a "Low-side switch" and the other as a "High-side switch". The two power switches are commonly connected in a totem pole or half-bridge circuit.
2. It provides level shifting circuits with a voltage offset capability greater than 600 volts to translate ground (substrate) referenced signals via an isolated portion of the silicon die to facilitate the drive function of the high side switch.
3. A logic circuit referenced to ground (substrate) that consists of comparators, a voltage regulator to control the magnitude of the output signals when the driver is supplied from non-regulated d-c or a-c supplies, undervoltage lockout circuits to prevent marginal operation of the MOS power switches, a dead band delay circuit that prevents "shoot through" or cross-conduction currents from flowing in the MOS power switches, and a logic function that allows the high side and low side drive outputs to alternate on a 50% time basis.
4. An additional logic output is provided so that the driver can self-oscillate at a frequency determined by external resistors and capacitors $R_T$ and $C_T$, respectively, where the frequency of oscillation $f_0$ is set by the relationship:

$$f_o = \frac{1}{1.4\, R_T \times C_t}$$

5. The monolithic die can be packaged in a number of conventional packages, such as an 8-pin DIP or 8-pin SOIC.
6. A novel start up sequence and power down sequence is employed to protect the power MOSFETs being driven and improves the predictability of this operation of the integrated circuit and the lamp ballast system.

DETAILED DESCRIPTION OF THE DRAWINGS

DETAILED DESCRIPTION OF THE DRAWINGS

Figure 1:
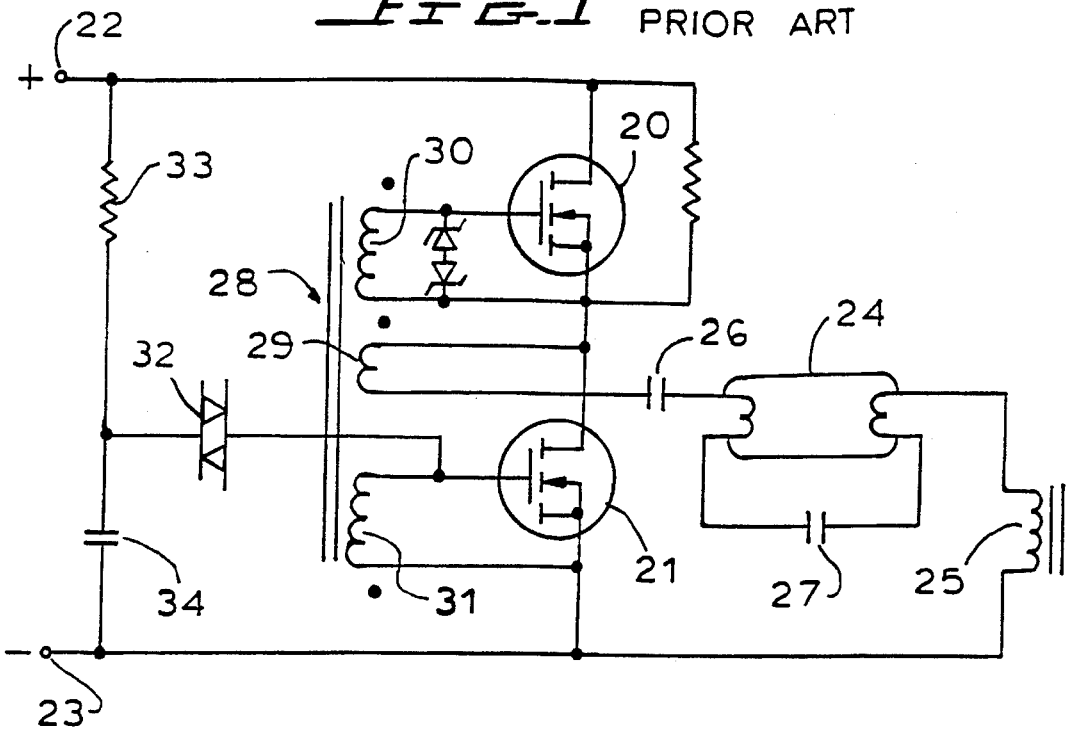
FIG. 1 PRIOR ART
FIG. 1 shows a prior art electronic ballast using a current transformer drive.

Referring first to FIG. 1, there is shown a prior art ballast using a current transformer drive. The circuit employs power MOSFETs 20 and 21 connected in a "totem pole", a half-bridge circuit, and driven from a d-c power source at terminals 22 and 23. The output circuit includes a gas discharge tube 24 of any desired type which is connected to a series L-C circuit consisting of inductor 25 and capacitors 26–27. A current transformer 28 has a primary winding 29 in series with tube 24 and secondary windings 30 and 31 connected to the gates of MOSFETs 20 and 21, respectively. A diac 32 is connected from the node between resistor 33 and capacitor 34 and the gate of MOSFET 21 to provide a starting pulse to start the circuit into oscillation. Once started, the circuit will operate at the resonant frequency of inductor 25 and capacitor 26.

More specifically, after MOSFET 21 turns on, oscillation is sustained, and a high frequency (30 to 80 kHZ) excites the L-C circuit. The sinusoidal voltage across capacitor 27 is magnified by the circuit Q at resonance, and develops a sufficient magnitude to strike the lamp 24.

The circuit of FIG. 1 is a holdover from known ballast designs using bipolar transistors and is not well suited to power MOSFETs because of poor switching waveforms.

The novel monolithic chip of the invention permits the drive of a ballast circuit which is self-starting, has improved switching time, is amenable to dimming, and avoids labor intensive inductor components such as the current transformer 28 of FIG. 1.

Figure 2:
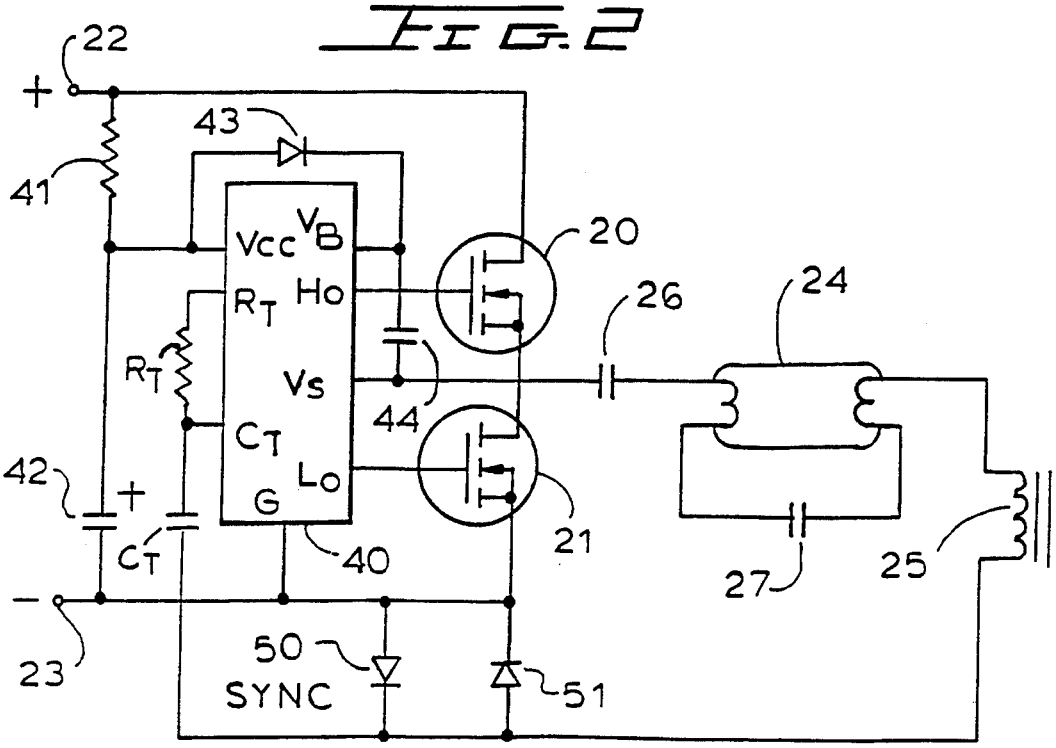
FIG. 2 shows a generalized electronic ballast for gas discharge lamps, which uses the monolithic circuit of the present invention.

FIG. 2 shows the novel monolithic MOS gate driver 40 of the invention in the ballast circuit of a gas discharge lamp. More specifically, the circuit of FIG. 2 has a gas discharge lamp 24 associated with the series L-C circuits 25, 26, 27 as in FIG. 1. Two power MOSFETs 20 and 21 are also connected to d-c source terminals 22 and 23 as in FIG. 1. Power MOSFETs 20 and 21 may be any power device which has a MOS gate, for example, an IGBT or a MOS gated thyristor. The chip 40 of FIG. 2 provides drive signals to the MOSFETs 20 and 21 which avoids the drawbacks of the prior art circuit of FIG. 1.

More specifically, chip 40 may be housed in an 8-pin DIP or surface mount package, and has the following pinouts:

$H_0$—an output pin to the gate of the high side MOSFET 20;

$V_S$—a pin to the center tap of the totem-pole or half bridge connected MOSFETs 20 and 21.

$L_0$—an output pin to the gate of the low side MOSFET 21.

G—a pin connected to the negative terminal 23 of the d-c source.

$C_T$—a single input control pin which is connected to the node between timing capacitor $C_T$ and timing resistor $R_T$. The other side of capacitor $C_T$ is connected to inductor 25 in this particular embodiment but it may also be connected to the negative terminal 23. The signal at pin $C_T$ controls both outputs $H_0$ and $L_0$.

$R_T$—a pin which is connected to the other terminal of timing resistor $R_T$.

$V_{cc}$—a pin which receives a chip operating voltage from the node between resistor 41 and capacitor 42.

$V_B$—a pin connected to the node of diode 43 and capacitor 44, which acts as a "bootstrap" circuit to provide power for the operation of the high side switch.

Also provided in FIG. 2 are two back-to-back diodes 50 and 51 in series with the lamp circuit. These diodes 50 and 51 form a zero-crossing detector for lamp in this particular embodiment.

In operation, and before tube 24 strikes, the resonant circuit consists of inductor 25 and both capacitors 26 and 27. The capacitance of capacitor 27 is lower than that of capacitor 26 so that it operates at a higher a-c voltage than that of capacitor 26. This voltage on capacitor 27 strikes the lamp 24. After lamp 24 strikes, capacitor 27 is effectively short circuited by the lamp voltage drop and the frequency of the resonant lamp circuit now depends on inductor 25 and capacitor 26.

This causes a shift to a lower resonant frequency during normal operation, synchronized by the zero crossing of the a-c current at diodes 50 and 51, and using the resultant voltage to control the oscillator within chip 40. As will be shown, the oscillation frequency of the circuit is synchronized by the addition of resistor $R_T$ and capacitor $C_T$.

The chip 40 provides offset voltage capability up to or higher than +600 volts d-c between the Vs terminal and the G terminal of the IC and has a "front end" capability similar in function to that of the well known CMOS 555 timer I.C.

Chip 40 also has interior circuitry to provide a nominal 1 microsecond dead time between outputs of the alternating high side and low side outputs for driving switches 20 and 21. This dead time could vary from less than 100 nanoseconds to greater than 10 microseconds, depending upon the particular application of the I.C., and is designated to 1.) prevent cross-conduction currents from flowing in the power MOSFETs 20 and 21, and 2.) to allow an external "snubber" circuit (e.g. resistor 70*a* and capacitor 70 in FIG. 3) to control the ½ bridge output voltage slew rate in order to reduce radiated EMI noise.

As will also be later shown, the chip 40 will be supplied at terminal 22 by a rectified a-c voltage and, therefore, is designed for a minimum quiescent current, and has a 15 volt interval shunt regulator. Thus, a single one-half watt dropping resistor 41 can be used to supply quiescent current to the I.C.

In addition to the I.C.'s static quiescent current there are two other components of d-c supply current that are a function of the actual application circuit.

1) Current due to charging the input capacitance of the power switches.

2) Current due to charging and discharging the junction isolation capacitance of the gate driver chip.

Both components of current are charge related and therefore follow the rules:

$$Q=CV$$

It can readily be seen, therefore, that to charge and discharge the power switch input capacitances, the required charge is a product of the gate drive voltage and the actual input capacitances and the input power required is directly proportional to the product of charge and frequency and voltage squared:

$$\text{Power}=\frac{CV^2}{2}\times f$$

When designing an actual ballast circuit and because of the above relationships, the following should be observed:

1) Select the lowest operating frequency consistent with minimizing inductor size.

2) Select the smallest die size for the power switches consistent with low conduction losses. (This reduces the charge requirements.)

3) Use the lowest possible d-c voltage.

In summary, the circuit of FIG. 2, when driven by chip 40, provides a self-oscillating square wave generator with dead time control and level shifting for the MOS gated devices in the circuit. Unlike the prior art current transformer driver, the novel system provides clean "text book" waveforms to minimize switch losses. As a result, for a given load power, in many cases smaller size MOSFETs can be selected or, alternatively, heat sinks may be reduced or eliminated.

Figure 3:
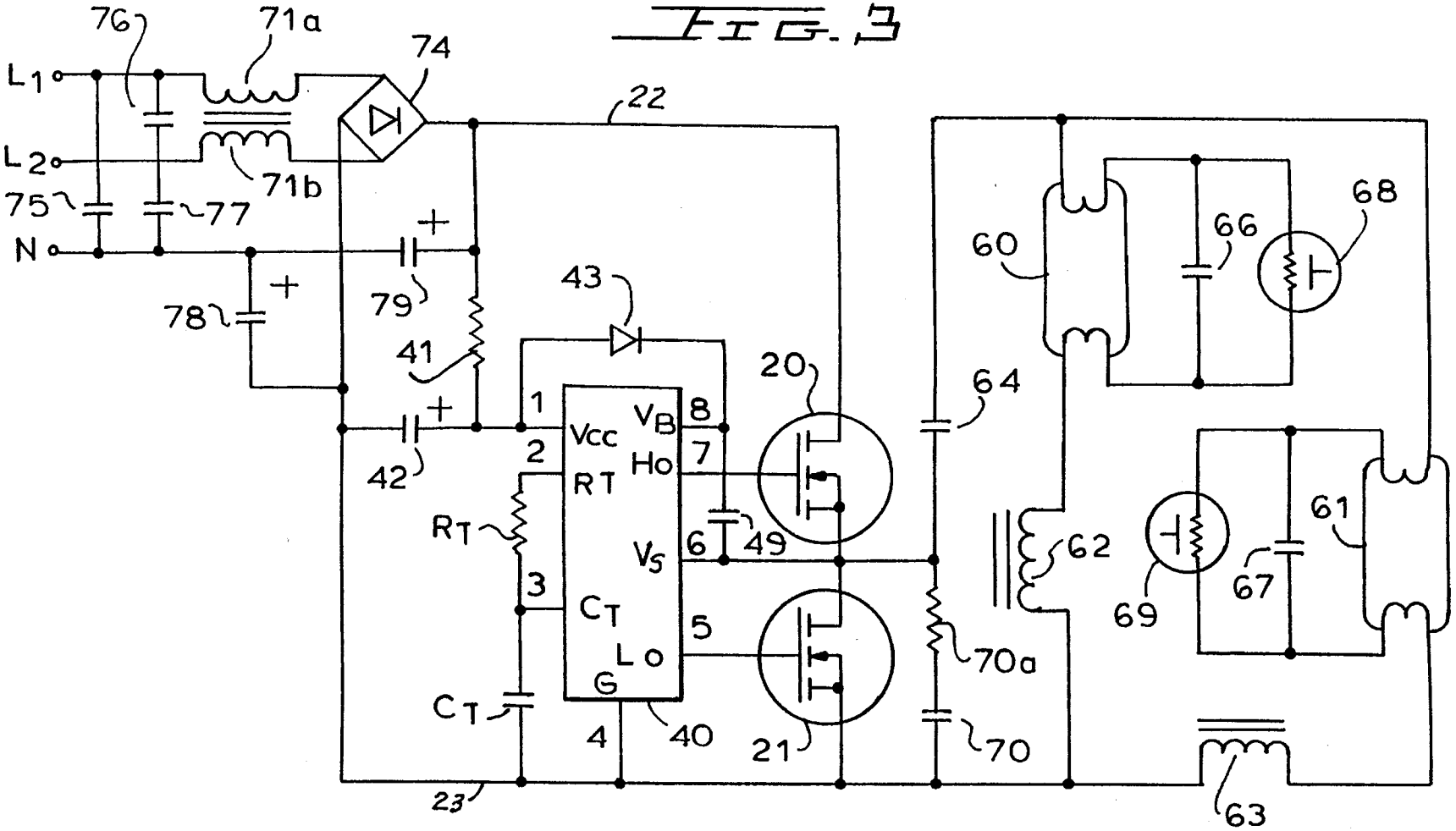
FIG. 3 shows a circuit diagram of a "double 40" fluorescent ballast, which uses the monolithic MOS gate driver of the invention.

FIG. 3 shows an exemplary ballast circuit which could employ the chip 40 of the FIG. 2 for a "double 40" fluorescent lamp ballast. In FIG. 3, components similar to those of FIG. 2 have the same identifying numerals. The lamp circuit in FIG. 3 employs two 40 watt fluorescent lamps 60 and 61 in a common reflector which have respective series inductors 62 and 63 and series capacitor 64. Each of tubes 60 and 61 have parallel capacitors 66 and 67, respectively, and parallel positive temperature coefficient thermistors 68 and 69, respectively. A snubber consisting of capacitor 70 and resistor 70*a* is connected from the node between MOSFETs 20 and 21 and the return line 23.

The input a-c circuit includes an a-c source having two a-c terminals $L_1$ and $L_2$ and a neutral terminal N. A conventional filter circuit including 30 microhenry inductors 71*a* and 71*b* is connected to a single phase full wave rectifier 74 having a positive output connected to resistor 41 and a negative terminal connected to capacitor 42, providing a 320 volt d-c output from a 220 volt a-c input. The input filter further includes capacitors 75, 76 and 77 as well as d-c capacitors 78 and 79.

Note that chip 40 of FIG. 3 operates directly off the d-c bus through dropping resistor 41 and oscillates in compliance with the following relationship:

$$fosc = \frac{1}{1.4\,R_T C_T}$$

Power for the high side switch gate drive comes from bootstrap capacitor 44 (typically about 0.1 μF, but generally at least ten times greater than the input capacitance (Ciss of the power MOSFET 20) which is charged to approximately 14 volts whenever pin $V_S$ is pulled low during the low side power switch conduction. The bootstrap diode 43 (11DF4 in this embodiment) blocks the d-c bus voltage when the high side switch conducts. Diode 43 is a fast recovery diode (<100 nSec) to ensure that the bootstrap capacitor 44 is not partially discharged as the diode 43 recovers and blocks the high voltage bus.

The high frequency output from the half bridge 20–21 would be a square wave with very fast transition times (approximately 50 nSec). In order to avoid excessive radiated noise from the fast wave fronts, a 0.5 watt snubber **70–70*a*** (10 Ω and 0.001 μF, respectively), is used to slow down the switch times to approximately 0.5 μSec. Note that there is a built-in dead time of 1 μSec to prevent shoot-through currents in the half bridge.

The fluorescent lamps 60 and 61 are operated in parallel, each with its own L-C resonant circuit. Any number of tube circuits can be driven from the single pair of MOSFETs 20 and 21 sized to suit the power level.

The reactance values for the lamp circuit are selected from L-C reactance tables or from the equation for series resonance:

$$f = \frac{1}{2\pi\sqrt{LC}}$$

The Q of the lamp circuits is fairly low because of the need for operation from a fixed frequency which, of course, can vary because of $R_T$ and $C_T$ tolerances. Fluorescent lamps do not normally require very high striking voltages so a Q of two or three is sufficient. "Flat" Q curves tend to result from larger inductors and small capacitor ratios where:

$$Q = \frac{2\pi fL}{R}$$

and R tends to be larger as more turns are used.

Soft-starting with tube filament pre-heating is accomplished by P.T.C. thermistors 68 and 69 across each lamp. In this way the voltage across the lamp gradually increases as the P.T.C. thermistor self-heats until finally the striking voltage with hot filaments is reached and the lamp strikes.

The following table gives the values of components used for a preferred embodiment of FIG. 3:

| | |
|---|---|
| MOSFETs 20, 21 | Type IRF 720 (International Rectifier) |
| PTC 68,69 | TDK 911P97ES014U10 |
| Bridge 74 | 4 × IN 4007 |
| Diode 43 | 11DF4 |
| Resistor 41 | 91 KOHMS, ½ watt |
| Resistor 70a | 10 OHMS, ½ watt |
| Resistor $R_T$ | 15 KOHMS |
| Capacitor 42 | 47 μf, 20 v |
| Capacitor 64 | 1 μf, 400 v |
| Capacitor 66, 67 | 0.01 μf, 600 v |
| 70 | 0.001 μf, 600 v |
| 75, 76, 77 | 0.22 μf, 250 v a–c |
| 78, 79 | 100 μf, 200 v |
| $C_T$ | 0.001 μf |
| Inductors 62, 63 | 1.35 millihenry |

Figure 4:
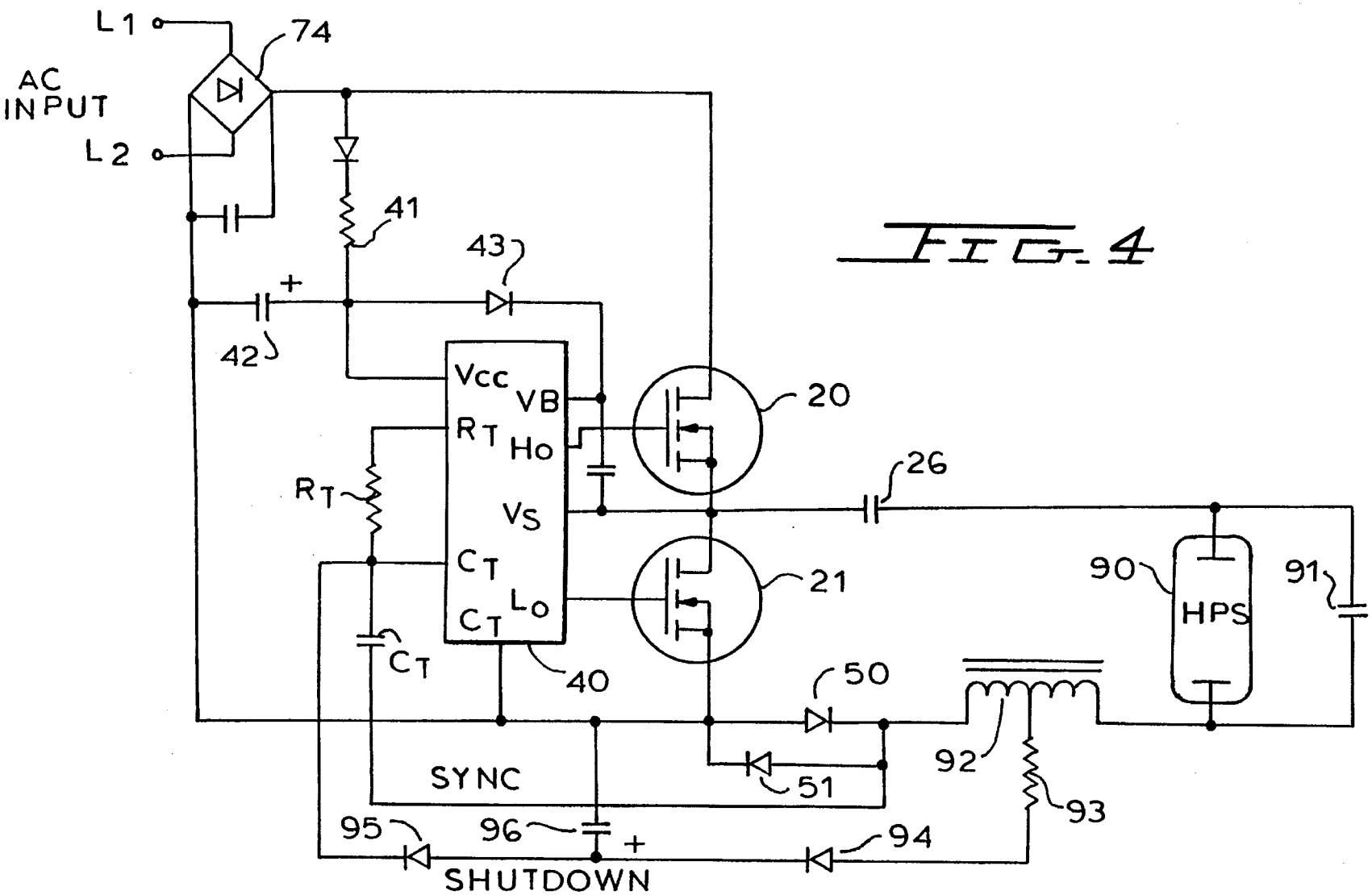
FIG. 4 shows a circuit diagram of a high pressure sodium ballast, using the novel MOS gate driver of the present invention.

FIG. 4 shows another embodiment of the invention for the drive of a high pressure sodium lamp ballast. The circuit of FIG. 4 has the synchronization circuit of FIG. 2 and also has an automatic shut-down circuit. In FIG. 4, components similar to those of FIGS. 2 and 3 have similar identifying numerals. In FIG. 4, the lamp is a high pressure sodium lamp 90 having a parallel capacitor 91 and an inductor 92. Inductor 92 has a tap which is part of a shut-down circuit, and includes resistor 93, diodes 94 and 95 and capacitor 96.

In FIG. 4, the synchronizing circuit consists of the zero crossing detector diodes 50 and 51 which synchronize the self-oscillation frequency to the true resonance of the LC circuit 91, 92. The Q of the series resonant circuit is made to be about 20 and provides sufficient voltage to strike lamp 90. The synchronizing capability of the chip 40 allows the series tuned circuit of FIG. 4 to resonate at high Q to provide the 3 kv starting voltage for lamp 90 without the use of a separate igniter.

In a hot restrike situation, where Q is insufficient to provide the necessary restrike voltage, the shutdown circuit including diodes 95 and 94 provides a d-c bias voltage which prevents the voltage at pin $C_T$ from reaching the ⅓ $V_{cc}$ valley switching point. Thus, the circuit provides "burps" of oscillation until restrike is accomplished (approximately 90 seconds) and sustained, and destructive high MOSFET currents are avoided.

Figure 5:
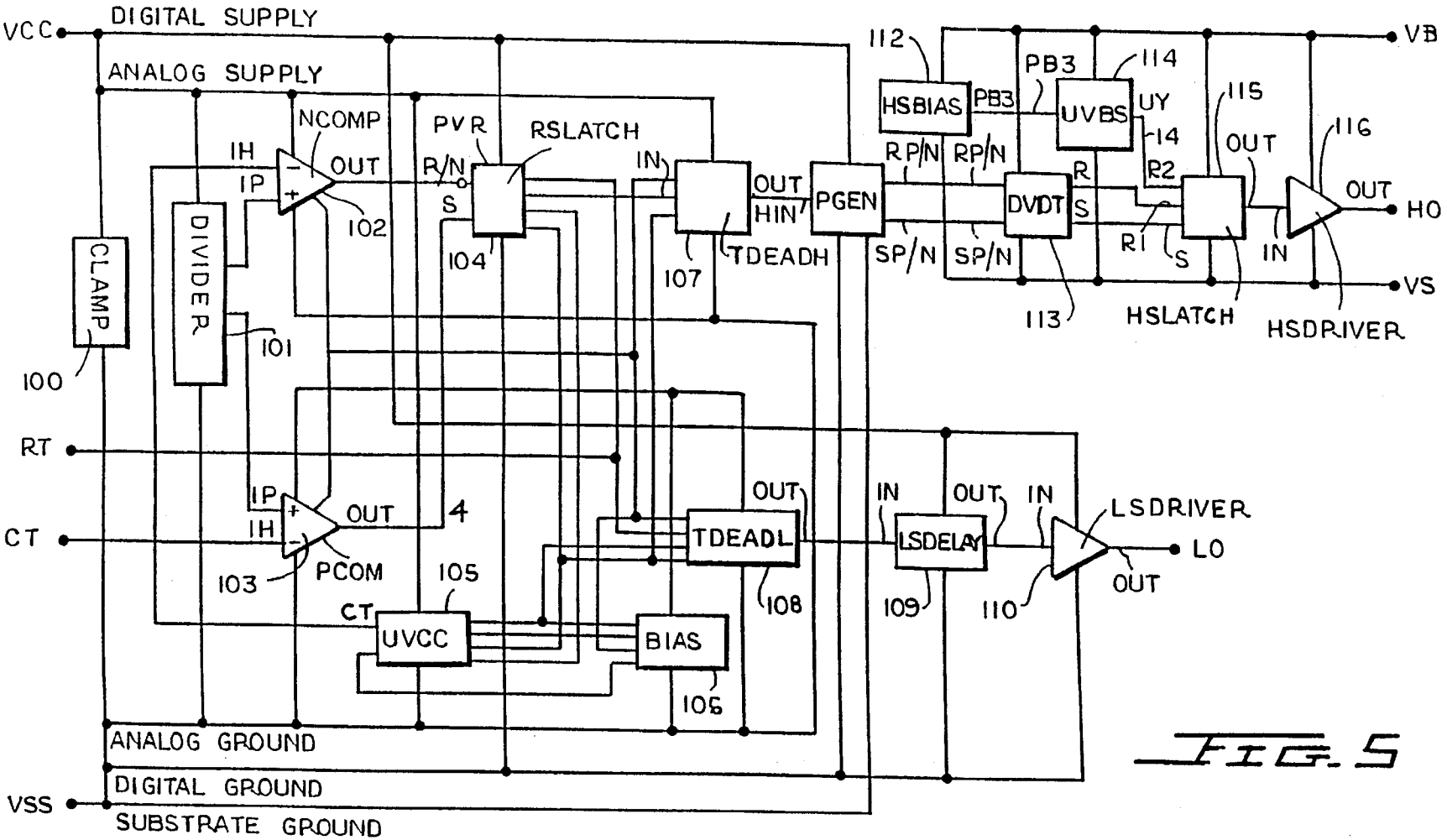
FIG. 5 is a block diagram of the novel monolithic gate driver shown in FIGS. 2, 3 and 4.

FIG. 5 is a block diagram of the circuit of chip 40 of the invention and of preceding FIGS. 2, 3 and 4. The eight pinouts of chip 40 are repeated in FIG. 5. All circuit blocks to be described in FIG. 5 are integrated into a common silicon chip. The first circuit block is the clamp circuit 100, consisting of a plurality of zener diodes. These are connected from pin $V_{cc}$ to pin $V_{ss}$ which is connected to the silicon substrate which acts as the chip ground. A digital supply line and analog supply line both extend from pin $V_{cc}$. An analog ground line and a digital ground line are also connected to pin $V_{ss}$.

The next group of circuit blocks form a timer circuit. These include divider circuit 101 connected to the analog supply line to the analog ground, N comparator 102, P comparator 103 and an RSLATCH 104. Two taps from divider 101 are connected to the positive inputs of comparators 102 and 103. Input pin $C_T$ is connected to the negative input of comparator 103. The output of comparators 102 and 103 are connected to the RS latch 104 as shown.

The RSLATCH 104 is also connected to under-voltage lock-out circuit 105 which is integrated into the chip circuit. Thus if $V_{cc}$ reduces too low, the RSLATCH 104 is locked out, and the output switching action is halted.

A bias circuit 106 provides bias outputs to the lockout circuit 105, and to dead time delay circuits 107 and 108 in the high side and low side circuit lines. Time delay circuits 107 and 108 provide a dead time or delay of about 1 microsecond between the turn on of the high side or low side switch after the turn off of the other. This dead time ensures that a "shoot through" circuit cannot be formed in which both power MOSFETs 20 and 21 are simultaneously on, and can vary from less than 100 nsec to more than 10 μsec.

The output of dead time circuit 108 is applied to low side delay circuit 109 and low side driver 110 which is connected to pin $L_O$.

The output of dead time circuit 107 is applied to level shift pulse generator 111 in the high side output line. The high side line also includes a high side bias supply circuit 112 which drives an under-voltage analog lockout circuit 114. Note that these high side bias supply and undervoltage lockout circuits are optional—the circuit will work well without them. A dv/dt filter circuit 113 filters noise from the pulse or pulses passed by circuit 111. The input to the high side bias circuit 112 is connected to pin $V_B$.

The output of lockout circuit 114 and dv/dt filter 113 is applied to latch circuit 115 and its output is connected to buffer 116 which contains gain stages and drives pin $H_O$. Note that pin $V_S$ is connected to circuits 112, 113, 114, 115 and 116.

The operation of the circuit of FIG. 5 can now be described. It has three primary operating modes, namely (A) system startup, (B) normal running mode, and (C) system powerdown.

A. System Startup

When the mechanical switch to the entire lamp system is set to the "on" position, all of the IC input and output node voltages and currents are initially zero. The rectifier 74 (FIG. 3) will quickly develop a dc bus voltage (e.g., +320 V) at node 22 relative to node 23, and this will cause capacitor 42 to charge up through resistor 41. Capacitor 42 supplies a voltage to the Vcc terminal of the IC 40, which in turn supplies power to all of the internal circuits of IC 40. When sufficient voltage has been developed on capacitor 42, the UVCC block 105 (FIG. 5) presets many of the other circuits in a desired state. Specifically, (1) the gate driver output LO is held low to prevent unwanted conduction of the power MOSFET 21, (2) the RT pin is set high (to the Vcc potential), (3) the CT pin is held low (at the Vss potential), and (4) the bias circuit block 106 is set in a "micropower" mode, where most of the IC circuit blocks are unbiased. This "micropower" startup mode is desirable because it reduces the current requirement from startup resistor 41, which enables the user to use a higher valued, lower wattage resistor (i.e., power consumption is reduced). The circuit blocks which drive the high-side power MOSFET 20 gate derive their power from a separate "bootstrap" supply, and as such require a distinct startup-controlling circuit UVBS 114. Much like the circuit block UVCC 105, circuit block UVBS 114 ensures that for a VB-to-Vs potential of less than a preset, designed voltage level (e.g., 8.5 V), that output HO is held at the Vs level, preventing unwanted conduction of the upper power MOSFET 20. The startup-controlling function of block 114 can be integrated into the HSLATCH 115, in which case a discrete UV block 114 and bias block 112 would be unnecessary.

When the Vcc terminal reaches a similar preset, designed voltage level, (1) the low-side gate driver output voltage LO goes high, turning on the power MOSFET 21, (2) the bias current block 106 is instructed to supply power to the oscillator comparators NCOMP 102 and PCOMP 103 and the dead time circuits TDEADH 107 and TEADL 108, (3) the RT pin is held high by the RSlatch 104, and (4) the CT pin is allowed (by the UVCC 105 circuit) to charge up from the Vss potential through the RT resistor (which is connected between the RT and CT pins). In other embodiments of this I.C., at startup, the RSLATCH 104 is configured to reverse the relationship between RT and CT (i.e., the RT pin is held low and the CT pin is held high). In this topology, RT is out of phase with the LO output during normal operation.

The rate at which this CT pin charges up depends upon the values of the CT capacitor, RT resistor, and the supply voltage Vcc. In addition, because the RSLATCH 104 drives the LO output out of phase with the HO output, when LO goes high, HO remains low.

Turning the LO output on first, during system startup, serves an important function for the floating, high-side circuitry powered by the VB-to-Vs bootstrap circuit. During the Vcc ramp from the Vss potential (e.g., 0 Volts), the bootstrap capacitor 44 forms a capacitive divider with the output resonant capacitors 26 and 27, and the inductor 25 appears to be a short circuit (low frequency). Based upon typical values of these capacitors (e.g., C44=0.1 μF, C26=1 μF, and C27=0.01 μF), the output of the half-bridge circuit (Vs) will rise as Vcc rises. As a result, when the desired voltage level is reached on Vcc, the VB-to-Vs potential will be very low, and below the level required to safely drive the upper power MOSFET 20. The purpose behind turning the low-side power MOSFET 21 on first, then, is to short the Vs pin to the Vss potential, thereby charging the VB-to-Vs capacitor to within one diode forward voltage (the voltage drop across the "bootstrap" diode 43) of the Vcc-to-Vss potential.

B. Normal Running Mode

Once Vcc has reached its required voltage level, and LO has turned the low-side power MOSFET 21 on, CT begins charging through the RT resistor. When the CT pin reaches a predetermined upper threshold (i.e., ⅔×Vcc) the NCOMP comparator 102 gives a negative reset signal to the RSLATCH 104. This negative reset signal causes the outputs (RT and its complement RT/N) of the RSLATCH to reverse logic states, and the RT pin goes low (RT/N goes high). In this particular embodiment of the IC 40, the RT pin drives the low-side signal path to LO, and is in phase with this output. Note that the phase relationship between RT and LO is arbitrary; certain users of this IC will require RT to be out of phase with RT, even though LO will need to come on first during startup. As a result, when RT goes low, the LO output is driven low, turning off the low-side power MOSFET 21. The signal path from RT to LO is intentionally made as fast as possible (minimum delay), and is designed to accurately match the turn-off propagation delay from RT/N to HO. This ensures that a propagation delay mismatch between the high-side and low-side drivers does not systematically offset the duty cycle at the output Vs of the half-bridge from its desired 50% level.

When RT switches logic levels from high to low, RT/N (the second RSLATCH 104 output) goes high. This latter signal drives the high-side dead time circuit TDEADH 107, which drives the pulse generator PGEN 111, which level shifts the high-side on/off signals to the high-side circuitry. The dead time circuits are designed to generate a small delay (e.g., 1 μsec) to the "turn-on" signal in order to (1) provide a cross-conduction dead time for the power MOSFETs 20 and 21, and (2) facilitate zero-voltage switching techniques for drive frequencies above the L-C resonant frequency (where the load impedance is inductive). Conversely, these dead time circuits are designed to add as little delay as possible to the "turn-off" signals to the gate drivers 110 and 116. After the high-side dead time circuit TDEADH 107 timeout period (e.g., 1 μsec), the pulse generator PGEN 111 is given the logic signal to translate a "turn-on" signal to the high-side gate driver 116. The DVDT circuit 113 discriminates short pulses (e.g., 50–200 nsec) emitted by the pulse generator, and translates these pulses into "set" and "reset" signals for the HSLATCH 115. RT/N going high corresponds to a "set" signal at the input to the HSLATCH, which in turn gives the HSDRIVER 116 circuit the command to drive the HO output high.

Another result of the RT pin switching from a high to a low potential is that the resistor RT begins to discharge the CT capacitor from the ⅔ Vcc threshold (set by the DIVIDER 101 block) downward to the ⅓ Vcc threshold (also set by the DIVIDER 101 block). Upon reaching the ⅓ Vcc threshold, the PCOMP comparator 103 output goes high, giving a "set" signal to the RSLATCH 104. This "set" signal drives RT high, RT/N low, and results in the output of the half-bridge Vs going low. The antiphase relationship between RT and CT results in self-oscillation at a 50% duty cycle, independent of the Vcc potential and temperature. This duty cycle control, combined with carefully matched turn-off propagation delays from RT to LO and RT/N to HO, respectively, result in a 50% duty cycle at the output of the half-bridge Vs.

C. Powerdown

The UVCC block within the IC senses the IC 40 supply voltage, Vcc, and compares it with a fixed reference voltage to determine if it is safe to continue switching on and off the power MOSFETs 20 and 21. In order to avoid falsely triggering this circuit by means of high frequency noise on the supply, the UVCC block comparator has hysteresis, and therefore switches states at a lower voltage on the supply when it is falling than when it is rising.

During normal (or abnormal) powerdown, when the supply voltage Vcc falls below the lower UVCC comparator threshold, an output signal instructs the high-side and low-side gate drivers to halt switching, and sets both HO and LO in the low state. This protects the power MOSFETs 20 and 21 from what would be excessive self-heating at low gate voltages.

In addition to terminating output switching, the UVCC block 105 also (1) pulls the CT pin to the Vss potential, (2) sets the RSLATCH 104 in a state such that RT is pulled high, and (3) disconnects the bias supply to the oscillator comparators 102 and 103, and the dead time circuits 107 and 108. This bias supply disconnection returns the IC 40 back into the micropower state where power dissipation is kept to a minimum.

It should be first noted that there are two possible phase relationships between the RT oscillator output and the gate driver outputs. The first of these relationships, where RT is in phase with the LO output, has been used in the preceding description of the operation of the IC 40. The other possible relationship has RT out of phase with LO, and in phase with HO. This latter phase inversion is important in certain applications where negative feedback is used between the LO output and the CT pin (or between the ac supply voltage and the CT pin) in order to regulate the output duty cycle between 0 and 50% in a closed loop fashion.

With this latter phase relationship (i.e., RT out of phase with LO), the startup and powerdown sequences require CT to be set high and RT to be set low, in order to ensure that the LO output still turns on first during system startup.

Figure 6:
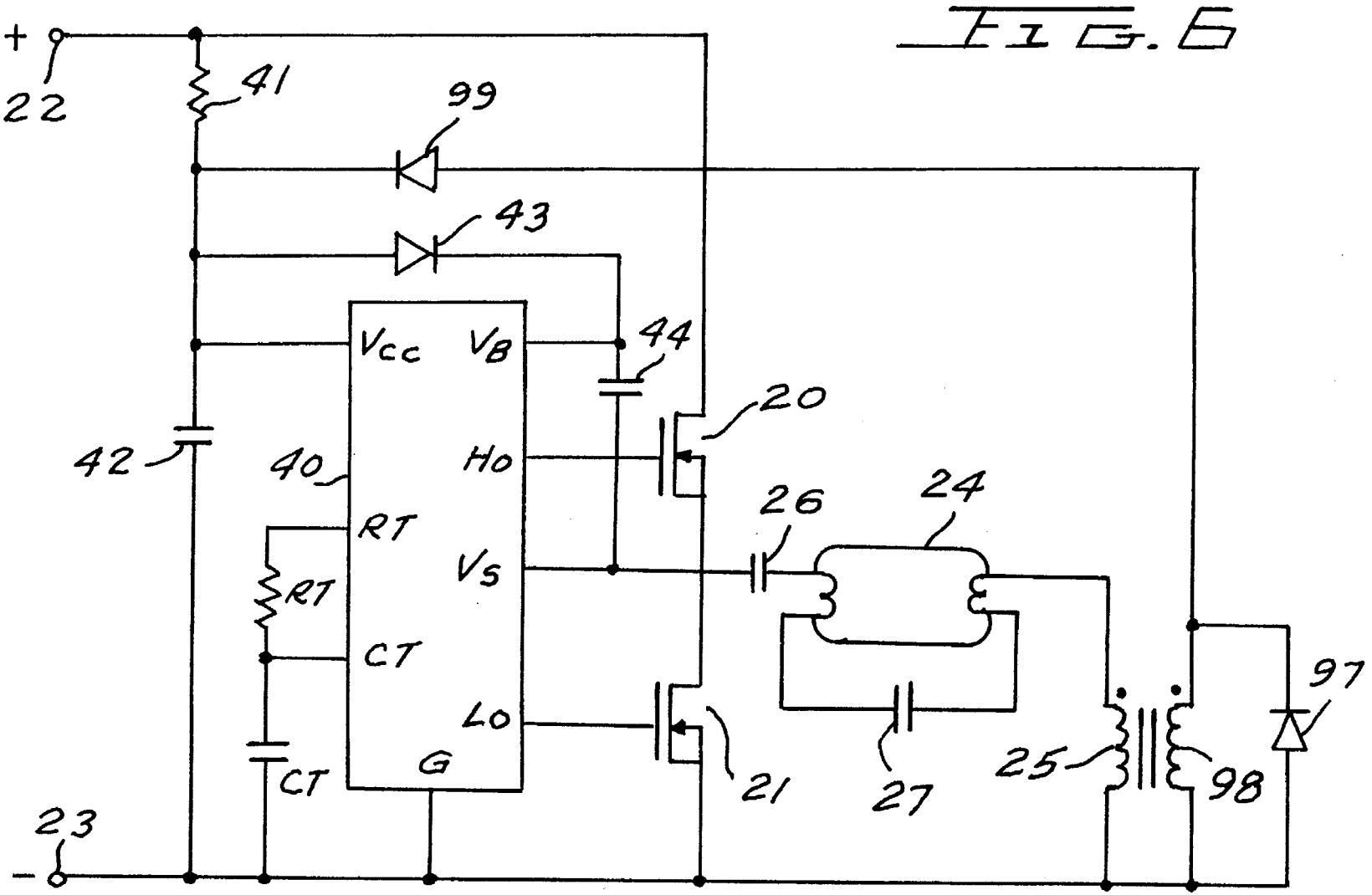
FIG. 6 is a circuit diagram which employs a charge pump from the output of the half bridge.
Figure 1:
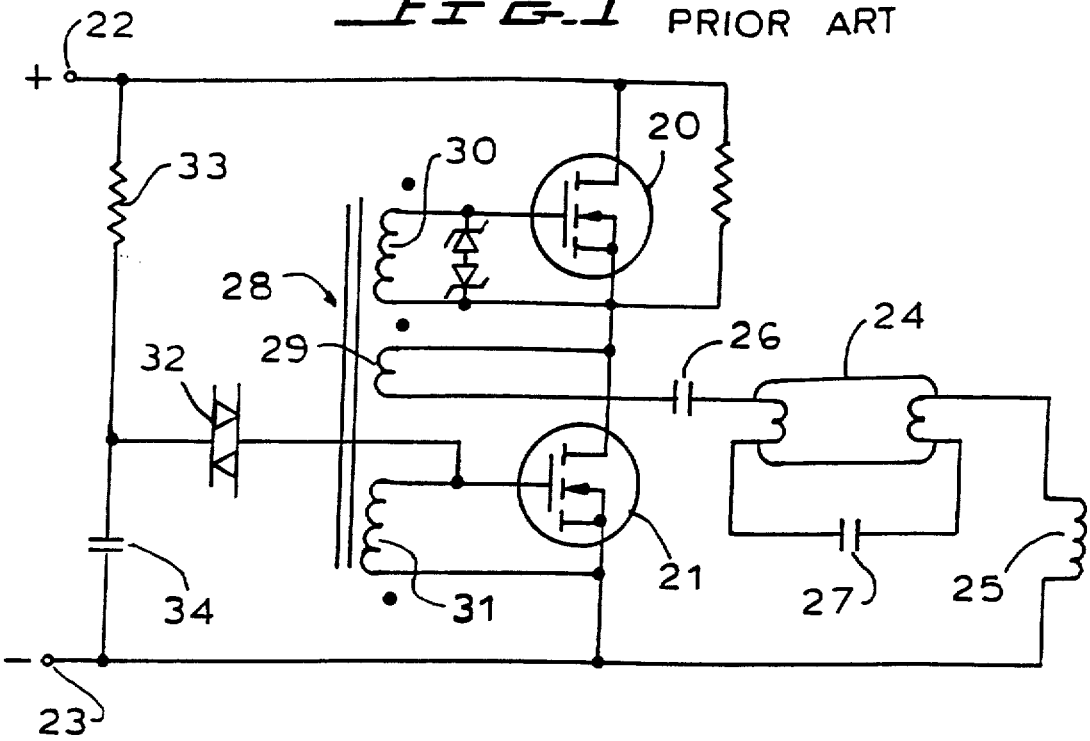
FIG. 1 PRIOR ART
Figure 2:
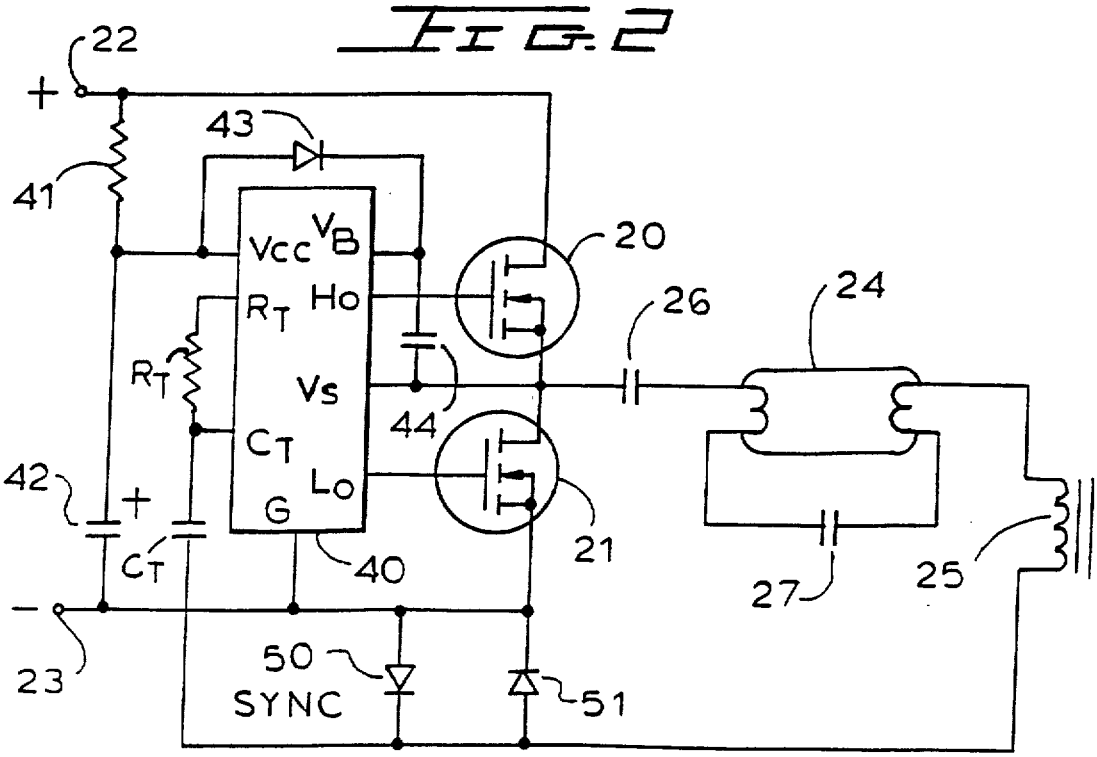
Figure 5:
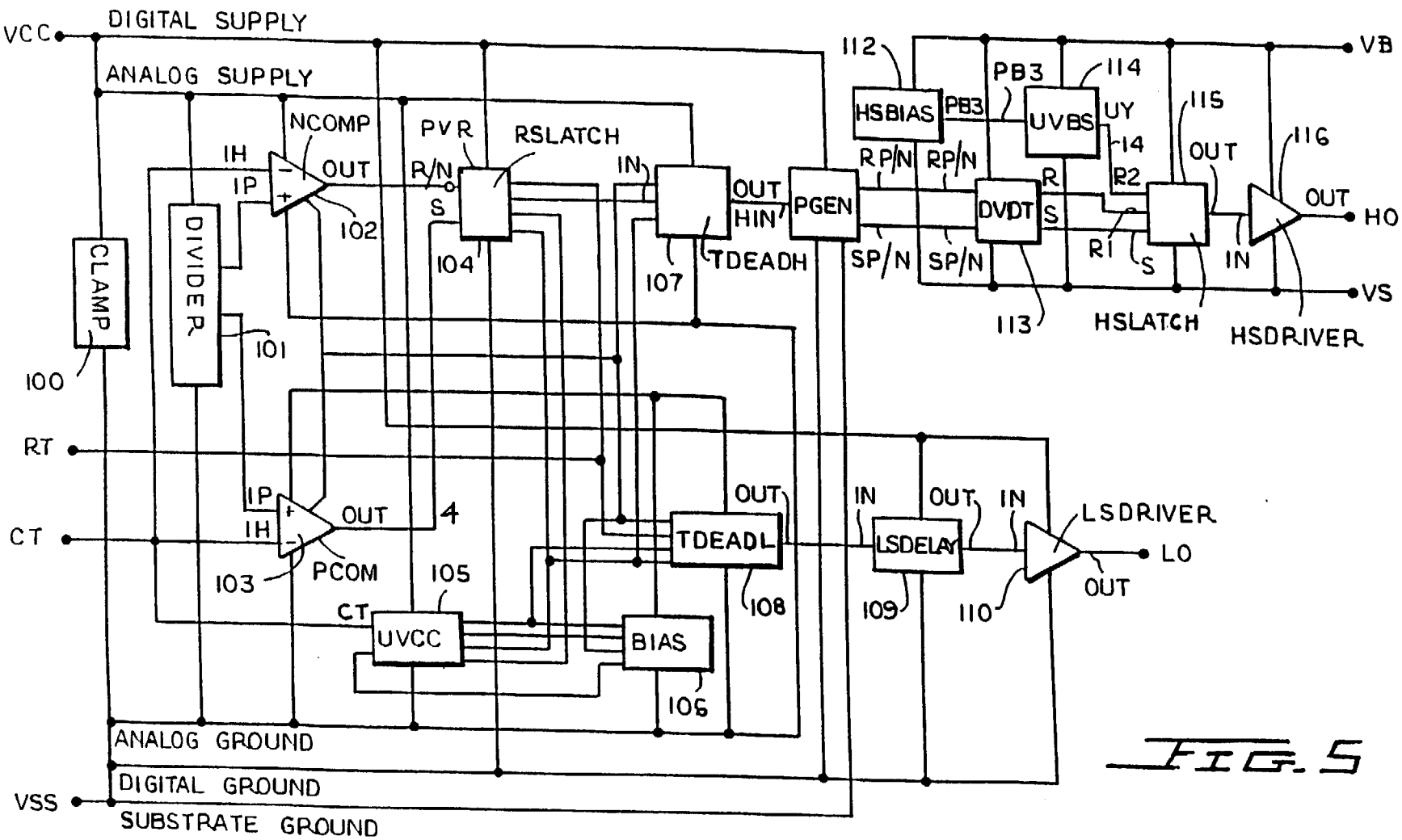
Figure 6:
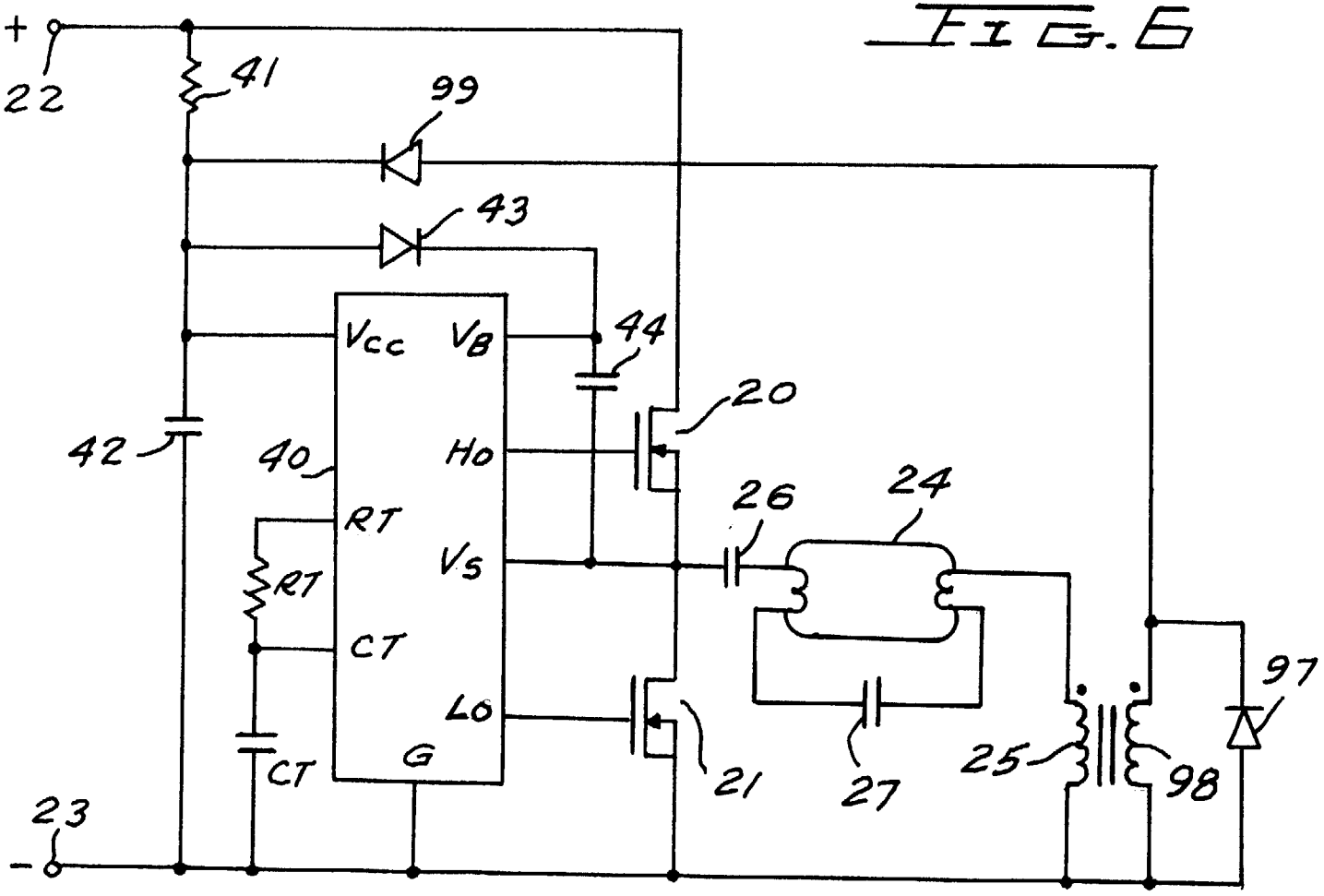

It should be further noted that it is also possible to save power during startup and powerdown by setting the RT and CT pins in the same state (i.e., both high or both low) when the IC 40 supply voltage Vcc is less than the UVCC "safety" thresholds. In the previously described embodiment, the RT and CT pins are set in opposite states during powerup and powerdown. As a result, during this mode of operation, current flows through the RT resistor, which in effect shunts the supply voltage of the IC 40. This places an additional burden on the high voltage bias resistor 41, which supplies at a minimum all of the powerup and powerdown current to the IC 40. If RT and CT are set in the same state, no voltage drop would occur across the RT resistor, and the high voltage bias resistor 41 could conceivably be reduced from ½-watt rating to a ⅛-watt rating. It should be recognized, however, that if this power reduction technique is to be effective, an alternate means of deriving the operating supply voltage of the IC 40 is needed. Thus, as shown in FIG. 6, a simple charge-pumping scheme from the output of the half-bridge Vs, can be used. The circuit of FIG. 6 is similar in operation to that of FIG. 3, with the exception that the circuit of FIG. 3 illustrates a 2-lamp output circuit, and includes details such as an output snubber (capacitor 70 and resistor 70*a*), lamp-starting PTCs 68 and 69, and an input filter and 320 V dc bus-generating rectifier/capacitor arrangement (components 71*a*, 71*b*, and 74 through 79). Added in FIG. 6 are a secondary winding 98 for inductor 25 and charge-pumping diodes 99 and 97.

In this circuit resistor 41 is used only as a means of starting the IC 40, and therefore can be of high value and low wattage (e.g., 1.5 MΩ and ⅛-watt). Its purpose is to charge the IC supply decoupling capacitor 42 up to the UVCC threshold, and overcome the small (e.g., <50 μA) micropower bias current flowing in the IC 40.

Once the rising UVCC supply threshold has been reached, the decoupling capacitor 42, along with the diode 99 and transformer formed by inductors 25 and 98, provide virtually all of the IC 40's supply current requirements.

When the output of the half-bridge circuit Vs excites the series resonant load circuit such that the voltage on the inductor 25 which is connected to the lamp 24 and capacitor 27 is positive, a positive voltage is induced on the inductor 98 connected to diode 99 and 97. This latter positive voltage is used to charge capacitor 42 by means of the rectifying diode 99. Conversely, when the voltage on the aforementioned node of inductor 25 is driven negative by the output of the half-bridge Vs, the induced negative voltage on inductor 98 is blocked by the reverse-biased diode 99, with a clamp diode 97 limiting this negative excursion to a diode forward voltage (approx 0.7 V). This "bootstrap" charge-pumping action is very similar to that of the diode 43 for capacitor 44, and forms an efficient means of supplying the proper amount of current and voltage to the IC 40.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A monolithic integrated circuit formed in a silicon substrate for driving first and second MOS gated power devices which are connected in a half bridge circuit which has first and second d-c terminals and a common terminal at the node between said first and second MOS gated power devices; said monolithic integrated circuit including timer circuit means having an input control terminal $C_T$ which is connectable to a low logic level signal referenced to the potential of said substrate; latch circuit means coupled to said timer circuit means for controlling the frequency at which said first and second MOS gated power devices are switched on and off and having an output which is switched in response to a predetermined signal applied to said input control terminal; a high side dead time delay circuit and a low side dead time delay circuit each coupled to said latch circuit means for delaying the transmission of a latch output signal for a predetermined time delay following the switching of the output of said latch circuit means; a high side level shifting means and a high side driver circuit means and a low side driver circuit means; said high side driver circuit means and said low side driver circuit means coupled to said high side dead time circuit and said low side dead time circuit, respectively, and having high side and low side output pins, respectively, which produce outputs for turning on and off said first and second MOS gated power devices in response to control signals at said input control terminal $C_T$; said high side and low side dead time delay circuits preventing the simultaneous conduction of said first and second MOS gated power devices; and an undervoltage circuit monitor means coupled to said high side driver circuit means and low side driver circuit means to disable said high side and low side driver circuit means as a function of an operating voltage $V_{cc}$ and a control voltage, said undervoltage circuit monitor means disabling said high side and said low side driver circuit means when said operating voltage is less than a first predetermined value during an initial startup of said half bridge circuit, said undervoltage circuit monitor means enabling said low side driver circuit means and supplying said control voltage to said input control terminal $C_T$ when said operating voltage is greater than said first predetermined value and less than a second predetermined value, and said undervoltage circuit monitor means disabling said low side driver circuit means and enabling said high side driver circuit means when said control voltage is greater than a third predetermined value, thereby protecting said first and second MOS gated power devices.

2. The integrated circuit of claim 1 wherein said MOS gated power devices are MOS devices which are selected from the group consisting of power MOSFETs, IGBTs and MOS gated thyristors.

3. The integrated circuit of claim 1 wherein said predetermined time delay varies from about 100 nanoseconds to 10 microseconds.

4. The integrated circuit of claim 1 which further includes a source of said operating voltage $V_{cc}$ coupled to said first and second d-c terminals for providing operating power for each of said low side and high side driver circuit means in said integrated circuit; said integrated circuit having a $V_{cc}$ pin extending therefrom for connection to at least one of said first or second d-c terminals.

5. The circuit of claim 4 which further includes resistor means for coupling said $V_{cc}$ pin to said first d-c terminal.

6. The integrated circuit of claim 4 wherein said low side under-voltage circuit monitor means is coupled to and monitors the voltage at said $V_{cc}$ pin and has an output coupled to said latch circuit means and to said high side and low side dead time circuits for disabling said latch circuit means and delay circuits when the voltage at said $V_{cc}$ pin falls below a given value.

7. The integrated circuit of claim 6 wherein said predetermined time delay is from 100 nanoseconds to 10 microseconds.

8. The integrated circuit of claim 2 which further includes a source of said operating voltage Vcc coupled to said first and second d-c terminals for providing operating power for each of said low side and high side driver circuit means in said integrated circuit, said integrated circuit having a $V_{cc}$ pin extending therefrom for connection to at least one of said first or second d-c terminals.

9. The circuit of claim 8 which further includes resistor means for coupling said $V_{cc}$ pin to said first d-c terminal.

10. An electronic ballast circuit including, in combination, at least one gas discharge lamp, at least one L-C circuit in series with said gas discharge lamp, first and second series connected MOS gate controlled power switching devices having respective gate terminals and connected in a half bridge circuit arrangement and formed in a substrate, a pair of d-c power terminals connected in series with said first and second series connected switching devices; said lamp and L-C series circuit connected across said second MOS gate controlled power switching device; and a monolithic gate drive circuit having an input terminal for receiving input logic level signals for alternately switching on and off both of said first and second MOS gated controlled power switching devices at a given frequency of oscillation; said monolithic gate drive circuit having output terminals $H_0$ and $L_0$ coupled to the respective gates of said MOS gate power switching devices; said gate drive circuit having a terminal $V_{cc}$ which provides the operating power for its internal circuitry; and an external resistor for connecting said terminal $V_{cc}$ to one of said pair of terminals; said monolithic integrated circuit including timer circuit means having an input control terminal $C_T$ which is connectable to a low logic level signal referenced to the potential of said substrate; latch circuit means coupled to said timer circuit means for controlling the frequency at which said first and second MOS gated power switching devices are switched on and off and having an output which is switched in response to a predetermined signal affixed to said input control terminal; a high side dead time delay circuit and a low side dead time circuit each coupled to said latch circuit means for delaying the transmission of a latch output signal for a predetermined time delay following the switching of the output of said latch circuit means; a high side level shifting means and a high side driver circuit means and a low side driver circuit means; said high side driver circuit means and said low side driver circuit means coupled to said high side dead time circuit and said low side dead time circuit, respectively, and having high side and low side output pins, respectively, which produce outputs for turning on and off said first and second MOS gated power devices in response to control signals at said input control terminal $C_T$; said dead time delay circuits preventing the simultaneous conduction of said first and second MOS gated power switching devices; and an undervoltage circuit monitor means coupled to said high side driver circuit means and low side driver circuit means, respectively, to disable said high side and low side driver circuits as a function of an operating voltage supplied to said terminal $V_{cc}$ and a control voltage; said undervoltage circuit monitor means disabling said high side and said low side driver circuits when said operating voltage is less than a first predetermined value during an initial startup of said half bridge circuit, said undervoltage circuit monitor means enabling said low side driver circuit and supplying said control voltage to said input control terminal $C_T$ when said operating voltage is greater than said first predetermined value and less than a second predetermined value, and said undervoltage circuit monitor means disabling said low side driver circuit and enabling said high side driver circuit when said control voltage is greater than a third predetermined value, thereby preventing damage to said electronic ballast circuit by protecting said first and second MOS gated power switching devices.

11. The integrated circuit of claim 1 wherein said undervoltage circuit monitor means comprises first undervoltage circuit monitor means coupled to said high side driver circuit means and second undervoltage circuit monitor means coupled to said low side driver circuit means.

12. The integrated circuit of claim 1 wherein said undervoltage circuit monitor means disables said high side and said low side driver circuits when said operating voltage falls below a fourth predetermined value during a powerdown of said half bridge circuit.

13. The electronic ballast circuit of claim 10 wherein said undervoltage circuit monitor means comprises first undervoltage circuit monitor means coupled to said high side driver circuit means and second undervoltage circuit monitor means coupled to said low side driver circuit means.

14. The electronic ballast circuit of claim 10 wherein said undervoltage circuit monitor means disables said high side and said low side driver circuits when said operating voltage falls below a fourth predetermined value during a powerdown of said half bridge circuit.

15. The electronic ballast circuit of claim 10 further comprising charge pumping means for controlling said operating voltage as a function of an output voltage supplied to said lamp and said L-C series circuit.

16. The electronic ballast circuit of claim 15 wherein said L-C series circuit includes an inductor that forms a primary winding of a transformer, and said charge pumping means includes a secondary winding of said transformer.

17. A monolithic integrated circuit formed in a silicon substrate for driving first and second MOS gated power devices which are connected in a half bridge circuit which has first and second d-c terminals and a common terminal at the node between said first and second MOS gated power devices; said monolithic integrated circuit including timer circuit means having an input control terminal $C_T$ which is connectable to a low logic level signal referenced to the potential of said substrate; latch circuit means coupled to said timer circuit means for controlling the frequency at which said first and second MOS devices are switched on and off and having an output which is switched in response to a predetermined signal applied to said input control terminal; a high side dead time delay circuit and a low side dead time delay circuit each coupled to said latch circuit means for delaying the transmission of a latch output signal for a predetermined time delay following the switching of the output of said latch circuit means; a high side level shifting means and a high side driver circuit means and a low side driver circuit means; said high side driver circuit means and said low side driver means coupled to said high side dead time circuit and said low side dead time circuit, respectively, and having high side and low side output pins, respectively, which produce outputs for turning on and off said first and second MOS gated power devices in response to control signals at said input control terminal $C_T$; said dead time delay circuits preventing the simultaneous conduction of said first and second MOS gated power devices; and an undervoltage circuit monitor means coupled to said high side driver circuit means and low side driver circuit means, respectively, to disable said high side and low side driver circuits as a function of an operating voltage $V_{cc}$ and a control voltage to protect said first and second MOS gated power devices; said undervoltage circuit monitor means comprising means for disabling said high side and said low side driver circuits when said operating voltage is less than a first predetermined value during an initial startup of said half bridge circuit, means for enabling said low side driver circuit and for supplying said control voltage to said input control terminal $C_T$ when said operating voltage is greater than said first predetermined value and less than a second predetermined value, and means for disabling said low side driver circuit and for enabling said high side driver circuit when said control voltage is greater than a third predetermined value.

18. The integrated circuit of claim 17 wherein said undervoltage circuit monitor means further comprises means for disabling said high side and said low side driver circuits when said operating voltage falls below a fourth predetermined value during a powerdown of said half bridge circuit.

19. The integrated circuit of claim 17 wherein said MOS gated power devices are MOS devices which are selected from the group consisting of power MOSFETs, IGBTs and MOS gated thyristors.

20. The integrated circuit of claim 17 wherein said predetermined time delay varies from about 100 nanoseconds to 10 microseconds.

* * * * *

UNITED STATES PATENT AND TRADEMARK OFFICE

CERTIFICATE OF CORRECTION

PATENT NO. : 5,550,436

DATED : August 27, 1996

INVENTOR(S) : Talbott M. Houk

It is certified that error appears in the above-identified patent and that said Letters Patent is hereby corrected as shown below:

The title page, showing the illustrative Figures should be deleted to be replaced with the attached title page.

In the drawings, Sheet 1, Fig. 2 and Sheet 5, Fig. 6, insert a node at the intersection of the vertical line drawn from reference numeral 20 to reference numeral 21 with the horizontal line drawn from $V_s$, as shown on the attached page.

In the drawings, Sheet 4, Fig. 5, insert a node at the intersection of the horizontal line drawn from the CT input of the chip with the vertical line which connects to the CT input of UVCC block 105. as shown on the attached page.

United States Patent [19]

Houk

[11] Patent Number: 5,550,436

[45] Date of Patent: Aug. 27, 1996

[54] MOS GATE DRIVER INTEGRATED CIRCUIT FOR BALLAST CIRCUITS

[75] Inventor: Talbott M. Houk, Culver City, Calif.

[73] Assignee: International Rectifier Corporation, El Segundo, Calif.

[21] Appl. No.: 299,561

[22] Filed: Sep. 1, 1994

[51] Int. Cl.[6] ..... H05B 41/00

[52] U.S. Cl. ..... 315/209 R; 315/224; 315/225; 315/DIG. 7; 315/219; 315/360; 363/49

[58] Field of Search ..... 315/209 R, 224, 315/225, DIG. 7, 360, 219; 363/24, 49, 17, 98; 327/142, 143

[56] References Cited

U.S. PATENT DOCUMENTS 5,001,400 3/1991 Nilssen ..... 315/209 R

OTHER PUBLICATIONS

Peter N. Wood, "Electronic Ballasts Using Cost-Saving IR2155 Driver," Application Notes, AN-995, International Rectifier, Feb.'94.

"High Voltage Versatility", Electronics World & Wireless World, pp. 837-839, Oct. 1994.

*Primary Examiner*—Robert Pascal
*Assistant Examiner*—Arnold Kinkead
*Attorney, Agent, or Firm*—Ostrolenk, Faber, Gerb, & Soffen, LLP

[57] ABSTRACT

A monolithic MOS gate driver chip is described for driving high side and low side power MOSFETs in a gas discharge lamp ballast circuit. The chip includes a timer circuit for generating a square output at the natural frequency of resonance of the lamp ballast. Dead time circuits are provided in the chip to prevent the simultaneous conduction of both high side and low side MOSFETs. The chip may be housed in an eight pin DIP package.

20 Claims, 5 Drawing Sheets

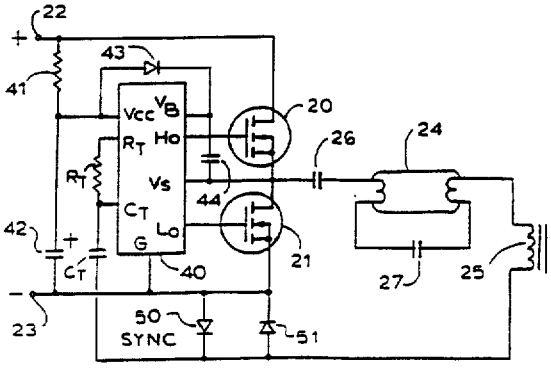

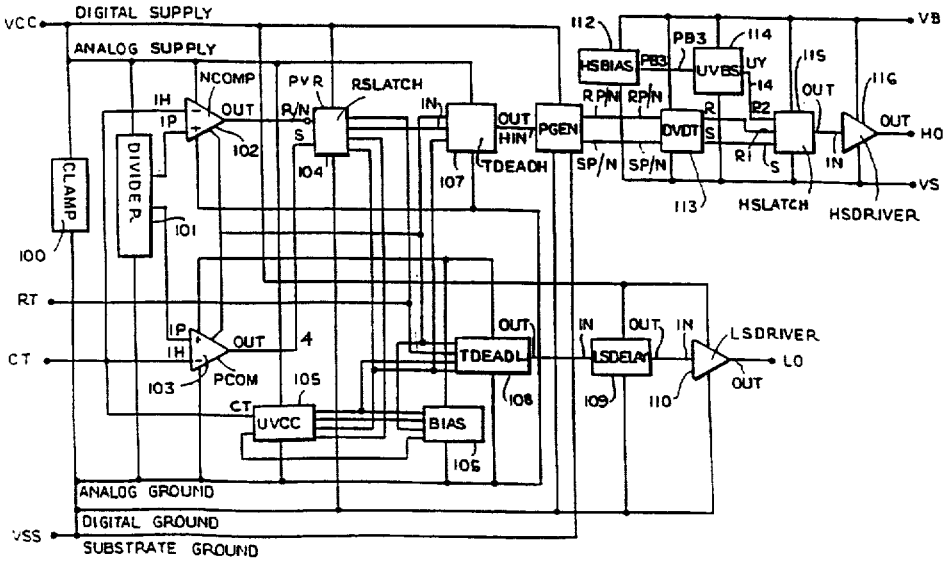

97
98
25
24
27
26
20
21
44
43
99
VB
HO
VS
LO
VCC
RT
CT
G
40
RT
CT
41
42
22
+
23
-

UNITED STATES PATENT AND TRADEMARK OFFICE

CERTIFICATE OF CORRECTION

PATENT NO. : 5,550,436

DATED : August 27, 1996

INVENTOR(S) : Talbott M. Houk

It is certified that error appears in the above-identified patent and that said Letters Patent is hereby corrected as shown below:

Column 11, lines 18-34, delete in their entirety and substitute therefor:

--for disabling said high side and low side driver circuit means as a function of an operating voltage $V_{CC}$, said undervoltage circuit monitor means disabling said high side and said low side driver circuit means when said operating voltage is less than a first predetermined value during an initial startup of said half bridge circuit, said undervoltage circuit monitor means enabling said low side driver circuit means and allowing a control voltage at said input control terminal $C_T$ to charge up when said operating voltage is greater than said first predetermined value, and said undervoltage circuit monitor means disabling said low side driver circuit means and said high side driver circuit means when said operating voltage is less than a second predetermined value, thereby protecting said first and second MOS gated power devices.--

UNITED STATES PATENT AND TRADEMARK OFFICE

CERTIFICATE OF CORRECTION

PATENT NO. : 5,550,436
DATED : August 27, 1996
INVENTOR(S) : Talbott M. Houk

It is certified that error appears in the above-indentified patent and that said Letters Patent is hereby corrected as shown below:

Column 11, line 51, delete "low side"; line 52, change "under-voltage" to --undervoltage--; line 55, after "dead time", insert --delay--; line 56, before "delay", insert --said--; line 57, change "a given" to --said predetermined--.

Column 11, line 58-59, change "predetermined" to --dead--.

Column 12, line 46, beginning with "coupled to", delete to line 64, ending in "switching devices." and substitute therefor:

--for disabling said high side and low side driver circuits as a function of an operating voltage supplied to said terminal $V_{CC}$; said undervoltage circuit monitor means disabling said high side and said low side driver circuits when said operating voltage is less than a first predetermined value during an initial startup of said half bridge circuit, said undervoltage circuit monitor means enabling said low side driver circuit and allowing a control voltage at said input control terminal $C_T$ to charge up when said operating voltage is greater than said first predetermined value, and said undervoltage circuit monitor means disabling said low side driver circuit and said high side driver circuit when said operating voltage is less than a second predetermined value, thereby preventing damage to said electronic ballast circuit by protecting said first and second MOS gated power switching devices.--

UNITED STATES PATENT AND TRADEMARK OFFICE

CERTIFICATE OF CORRECTION

PATENT NO. : 5,550,436
DATED : August 27, 1996
INVENTOR(S) : Talbott M. Houk

It is certified that error appears in the above-indentified patent and that said Letters Patent is hereby corrected as shown below:

Column 13, lines 3-7, delete in their entirety.

Column 13, lines 13-17, delete in their entirety.

Column 14, line 12, beginning with "coupled to", delete to line 28, ending in "third predetermined value." and substitute therefor:

--for disabling said high side and low side driver circuits as a function of an operating voltage $V_{CC}$ to protect said first and second MOS gated power devices; said undervoltage circuit monitor means comprising means for disabling said high side and said low side driver circuits when said operating voltage is less than a first predetermined value during an initial startup of said half bridge circuit, means for enabling said low side driver circuit and for allowing a control voltage at said input control terminal $C_T$ to charge up when said operating voltage is greater than said first predetermined value, and means for disabling said low side driver circuit and said high side driver circuit when said operating voltage is less than a second predetermined value.--

UNITED STATES PATENT AND TRADEMARK OFFICE

CERTIFICATE OF CORRECTION

PATENT NO. : 5,550,436
DATED : August 27, 1996
INVENTOR(S) : Talbott M. Houk

It is certified that error appears in the above-indentified patent and that said Letters Patent is hereby corrected as shown below:

Column 14, lines 29-34, delete in their entirety.

Column 14, line 40, change "predetermined" to --dead--.

Signed and Sealed this

Twenty-ninth Day of October 1996

*Attest:*

Bruce Lehman

BRUCE LEHMAN

*Attesting Officer*

*Commissioner of Patents and Trademarks*